US005704080A

United States Patent [19]

Kühne

[11] Patent Number: 5,704,080

[45] Date of Patent: Jan. 6, 1998

[54] SHOWER SUPPORT BRACKET

[75] Inventor: Josef Kühne, Jona, Switzerland

[73] Assignee: Hansa Metallwerke AG, Stuttgart, Germany

[21] Appl. No.: 670,711

[22] Filed: Jun. 26, 1996

[30] Foreign Application Priority Data

Jun. 30, 1995 [DE] Germany ..... 195 23 872.9

[51] Int. Cl.[6] ..... A47K 3/22

[52] U.S. Cl. ..... 4/605; 4/567; 248/219.3

[58] Field of Search ..... 4/567–570; 248/219.3, 248/218.4, 230.2, 295.11, 316.2, 316.3

[56] References Cited

U.S. PATENT DOCUMENTS

| | | | |
|---|---|---|---|
| 3,900,998 | 8/1975 | Hubbard . | |
| 4,430,017 | 2/1984 | Stefancich | 248/295.11 X |
| 5,277,391 | 1/1994 | Haug et al. | 4/605 X |
| 5,481,765 | 1/1996 | Wang | 4/567 X |
| 5,632,049 | 5/1997 | Chen | 4/570 |

FOREIGN PATENT DOCUMENTS

| | | | |
|---|---|---|---|
| 4 000 621 A | 7/1991 | Germany . | |
| 4140433 | 6/1993 | Germany | 4/567 |
| 1 376 126 | 12/1974 | United Kingdom . | |

*Primary Examiner*—Charles E. Phillips

[57] ABSTRACT

A shower support bracket can be moved axially on a shower rail and can be locked in various axial positions on the aforesaid rail by means of a clamping device. The clamping device locks on concealed gripping surfaces in a groove at the back of the shower rail. It consists of a clamping piece (7) which has two clamping jaws (**7*b*, 7*c*) separated from each other by a gap (13). A wedge-shaped expanding projection (14) extends into the gap (13) between the clamping jaws (7*b*, 7*c*) such that, as the clamping piece (7) and expanding projection (14) move relative to each other, the two clamping jaws (7*b*, 7*c*) move at varying distances apart and by so doing are pushed at varying depths into the receiving hole (5**) for the shower rail and in this way are pressed against the gripping surfaces of the shower rail with varying degrees of force.

12 Claims, 2 Drawing Sheets

SHOWER SUPPORT BRACKET

BACKGROUND OF THE INVENTION

1. Field of the Invention

The invention concerns a shower support bracket for the purpose of attaching a hand shower to a shower rail, the back of which, that is to say the side facing away from the user, has a groove in it with at least one gripping surface, comprising a) a housing;

b) a hole which receives the shower rail such that it has sliding movement;

c) a clamping device which consists of at least one clamping piece which can be pressed against the gripping surface of the shower rail with variable force in order to brake or stop the sliding movement;

d) a supporting device which acts in combination with the supporting component of the hand shower.

The purpose of shower support brackets is to attach a hand shower in different axial positions to a shower rail which is mounted—generally in a vertical arrangement—away from the wall of the bathroom etc. For this purpose, they have a clamping device which presses a clamping piece against the outer surface of the shower rail with varying degrees of force. The configuration may therefore be such that the clamping device generates only a braking force which is sufficient to prevent any unintentional movement of the shower support bracket and the hand shower under gravity effect. In this case, the hand shower with the shower support bracket can be moved along the shower rail by lightly pulling. Alternatively, it is also possible to clamp the shower support bracket tightly to the shower rail so that when the shower support bracket is required to be moved along the shower rail the clamping device has to be released.

In both cases there is a problem in that the clamping device can leave wear marks on the outer surface of the shower rail.

2. Discussion of Prior Art

A shower support bracket of the type named at the beginning is described in DE-A-40 00 621. In the case described, the problem of wear marks is circumvented in that the gripping surface is moved into a groove which is located in the back of the shower rail, that is to say the side facing away from the user. Any wear marks which are left there are inconsequential because they cannot be seen by the user. In the known shower support brackets, the groove at the back of the shower rail is dovetail in cross-section, where the bottom of the groove is broader than the exit slot in the groove on the back of the shower rail. This produces two gripping surfaces which are set at an angle to the back of the shower rail. The known shower support bracket is clamped on the shower rail in such a way that a sphere which is fitted to the shower support bracket is pressed against the bottom of the groove in the shower rail by means of a spring. Guide parts on the shower support bracket which extend into the groove in the shower rail and have complementary sloping gripping surfaces are thereby forced outwards to rest against the corresponding gripping surfaces of the shower rail. As already mentioned, this clamping device requires a dovetail clamping groove in the shower rail which, when viewed from outside, is undercut. Not all types of shower rails, however, have clamping grooves in them which are undercut.

OBJECT OF THE INVENTION

The purpose of this invention is to provide a shower support bracket of the type named at the beginning, comprising a clamping device which can be used with different profiles of the groove which is formed in the back of the shower rail.

This task is solved according to the invention in that e) the clamping device consists of:

ea) a clamping piece which has two clamping jaws, separated from each other by a gap and which can be expanded elastically by enlarging the intervening gap;

eb) a wedge-shaped expanding projection, the narrow front face of which is aligned with the gap between the clamping jaws of the clamping piece, whereby ec) the clamping piece and expanding projection are capable of movement relative to each other such that, depending upon the relative position between clamping piece and expanding projection, the expanding projection goes into the gap between the two clamping jaws to varying depths and so the clamping jaws expand to varying degrees.

According to the invention, the shower support bracket is held on the shower rail by means of two clamping jaws which can be forced apart in a different way. The clamping jaws act in combination with the side faces of the groove in the back of the shower rail and the angle at which these side faces is set relative to the back of the shower rail is irrelevant. So in practice, the grooves in the back of the shower rail can have any profile. The movement of the two clamping jaws apart occurs by means of an expanding projection which goes into the gap between the two clamping jaws to varying depths. All parts of the clamping device can be made cheaply out of plastic.

In order to compensate for the permissible variations of the clamping groove in the shower rail, it is advisable for the clamping jaws to be flexible in design, in one clamping direction at least.

In an advantageous configuration of the invention, the relative movement between clamping piece and expanding projection is such that the clamping piece is designed in the form of a clamp slide with linear movement, whereas the expanding projection is fixed.

In a further configuration of the invention, the requisite movement of the clamp slide is easy to achieve by permitting the clamp slide to be moved by an operating bar which can be screwed into a fixed part and which carries at the outer end a manual actuator. By turning the manual actuator, the clamp slide can then be moved further towards the expanding projection (which causes it to be held more tightly) or away from the expanding projection (in which case it is released from the clamped position).

A particularly advantageous configuration of the invention is one in which the clamping piece and the clamping jaws are manufactured in one piece from plastic and the clamping jaws are each flexibly connected to a main body of the clamping piece by means of relatively narrow material bridges. The clamping piece can therefore be manufactured in a single manufacturing process and in order to achieve the desired expanding capability of the two clamping jaws, use is made of the flexible properties of the relatively narrow plastic material bridges.

The shower rails of the type described here are not circular in section. This means that the shower support bracket cannot just automatically be turned about the longitudinal axis of the shower rail. For this to be possible, however, a configuration of the invention is recommended in which a) the hole which receives the shower rail has the form of a rail guide part which can be turned relative to the housing;

b) the clamping piece or the expanding projection can be moved in a recess in the rail guide part which opens towards the housing;

c) the gripping surfaces and/or the surfaces of the clamping piece which act in combination with the expanding projection are set at such an angle that as they move relative to each other, the clamping piece or the expanding projection also move radially towards the housing or away from it and, depending upon the relative position, are held on the housing with varying degrees of force.

In this configuration the rail guide part, which receives the shower rail form-fit, is still not capable of turning relative to the shower rail, whereas the housing of the shower support bracket and of course the hand shower attached to it can be turned relative to the rail guide part and therefore to the shower rail. By virtue of the sloping position of the gripping surfaces on the clamping piece or the interacting surfaces of clamping piece and expanding projection, a type of cam effect is created which, when the clamping piece and expanding projection are moved relatively towards one another, simultaneously creates a radial deflection movement of the moving part in question (clamping piece or expanding projection). As a result of this deflection movement, the rail guide part is clamped on the housing so that the turning movement of the housing relative to the rail guide part is arrested or blocked. In other words: the immobilization of the hand shower relative to the shower rail occurs both in the axial direction and also in the azimuthal direction by means of the same manual actuator which acts on a single clamping piece.

As a general principle, it is also desirable for the hand shower to be capable of turning about a horizontal axis such that the shower jets emerge from the hand shower at a different angle to the perpendicular. In this instance, a configuration of the invention is recommended in which the supporting device is formed on a supporting part which can be turned at least about a certain angle relative to the housing.

A preferred embodiment therefore is one in which the turning capability is restricted by a stop device which consists of:

a) curved recess going through the supporting part;

b) a pin which is attached to the housing and which goes through the recess.

The angle of turn permitted by this stop device is obviously preset by the angle which is formed by the curved recess and also by the diameter of the pin.

The force which is required to turn the supporting part can be adjusted as appropriate by a braking device which is mounted between the supporting part and the housing.

It is a particularly simple matter to fit the supporting part in the housing of the shower support bracket if a) the supporting part is housed in a slit-like recess in the housing which can be expanded elastically;

b) cylindrical bearing projections are preformed on to the supporting part which engage in corresponding holes in the side walls of the slit-like recess.

In order to fit the supporting part in the housing, the slit-like recess is elastically expanded slightly so that the supporting part with the protruding bearing projections can be inserted until these are opposite the corresponding holes in the side walls of the slit-like recess. These holes then engage elastically on the bearing projections.

Finally, it is expedient if the housing is composed of an inner housing which forms the bearing structure and an outer, visible housing which consists of several linked, but detachable parts.

In an advantageous configuration of the invention, an additional function is conferred on this visible housing, whereby there are on the visible housing, above the rail guide part, shoulders which secure the rail guide part axially.

DESCRIPTION OF THE DRAWINGS

One embodiment of the invention is explained in greater detail with the aid of the drawings.

DETAILED DESCRIPTION OF A PREFERRED EMBODIMENT

Figure 1:
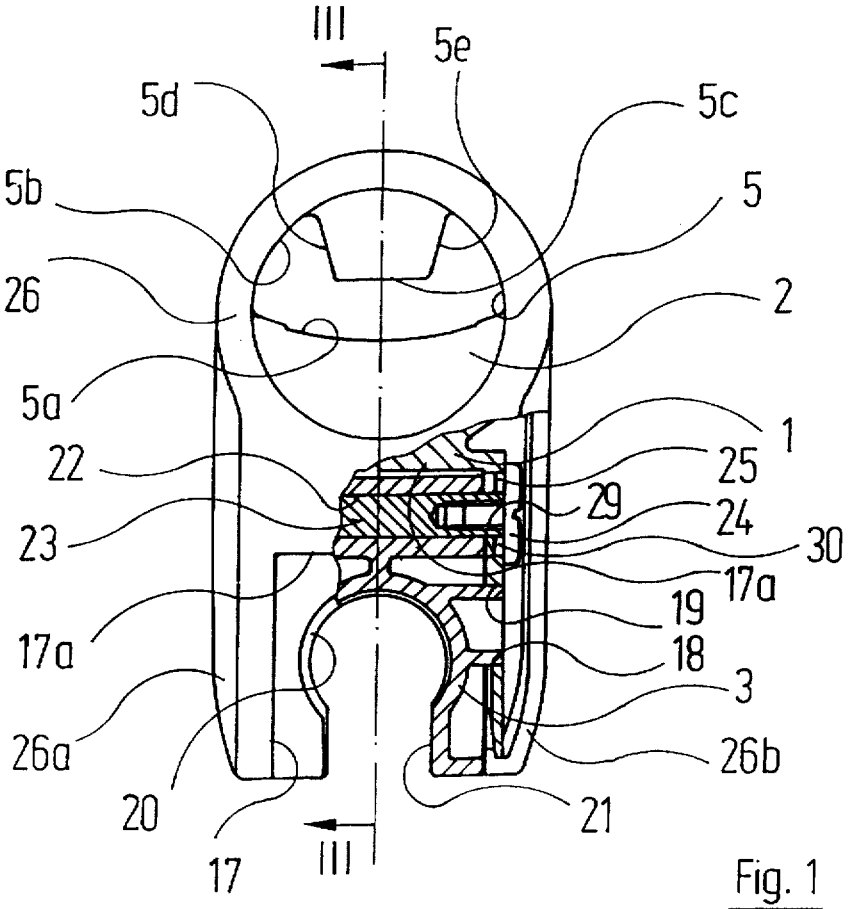
FIG. 1: shows a side view of a shower support bracket, illustrating some of the internal components in the area around the conical supporting part.

The shower support bracket illustrated in the drawing serves to connect the conical supporting part which is normally mounted on the handset of a hand shower to the shower rail which is normally mounted vertically on the wall of a bathroom. It is required to be connected in such a way as to ensure that the shower support bracket can slide longitudinally along the shower rail, can be held in any axial position and can at the same time be turned about the axis preset by the shower rail. In addition, the hand shower mounted on the shower support bracket should be capable of being angled relative to the shower support bracket so that the shower jets can emerge at varying angles relative to the perpendicular.

To achieve this, the shower support bracket illustrated in the drawing has four main components: an inner housing 1, the afore-mentioned rail guide part 2, on which a clamping mechanism is fitted in order to hold it against the shower rail, the already-mentioned conical supporting part 3 and also an outer visible housing 26.

First of all, a more detailed description is given of the exact structure of the rail guide part 2, the way in which this is attached to the inner housing 1 and also the structure and operation of the clamping mechanism.

Figure 2:
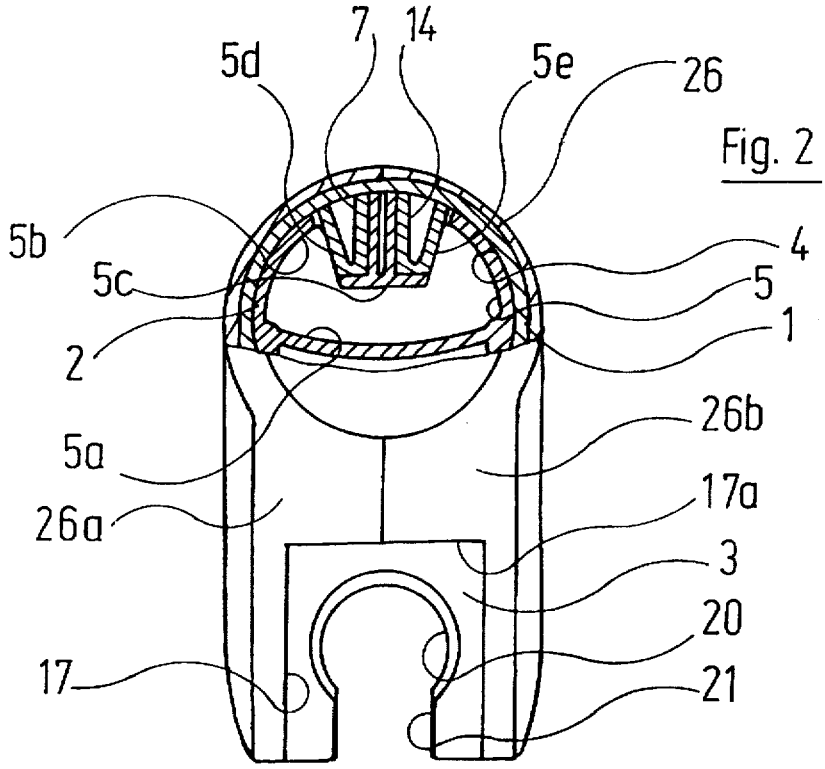
FIG. 2: shows the same side view of the shower support bracket, but this time illustrating some of the internal components in the area around the rail guide part.

As can be seen especially from FIG. 2, the inner housing has a receiving hole 4 which is circular in section, the outer diameter of which matches the outer diameter of the rail guide part 2 and in which the latter is housed in such a way that it can rotate.

The rail guide part 2 has an axial hole 5 going through it, the profile of which complements the outer profile of the shower rail on which the shower support bracket is to be mounted. As shown in the drawing, the shower rail in question is not circular in section and is bounded on the front, that is to say the side facing the user, by a curved surface which has a comparatively large radius, whereas the back of the shower rail, that is to say the side facing the wall of the bathroom, has a curved surface with a comparatively small radius, in the centre of which there is formed a groove which has sloping side walls and is flexible forwards, i.e. towards the user. These sloping side walls in the concealed groove—that is to say it is not visible to the user—serve, as will be described in greater detail later on, to hold the shower support bracket on to the shower rail. Since the gripping surfaces are not visible to the user mechanical damage, which is caused during use by the constant clamping and sliding of the clamping mechanism is not perceived by the user as being troublesome.

Figure 3:
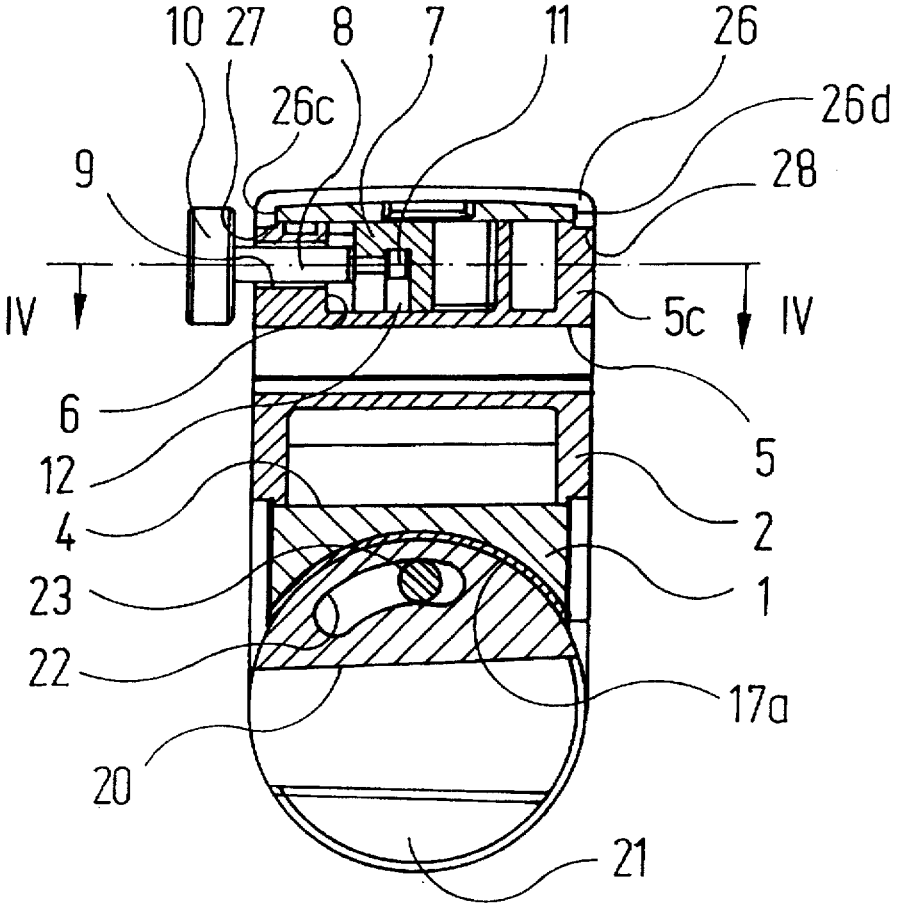
FIG. 3: shows a section through the shower support bracket illustrated in FIGS. 1 and 2, along a line III—III.

As already mentioned, the hole 5 going through the rail guide part 2 largely matches the outer profile of the shower rail which is not shown. This means that it also has a forwards facing area of contact 5*a*, the radius of curvature of which is relatively large and also a backwards facing area of contact 5*b* the radius of curvature of which is comparatively small and which has projecting from it a forwards pointing rib-shaped projection 5*c*. Symmetrical to the central plane of the shower support bracket, the rib-shaped projection 5*c* has two gripping surfaces 5*d* and 5*e* set at an angle to this central plane. There is formed in the rib-shaped projection 5*c* of the rail guide part 2 a recess 6 which, as illustrated in the view shown in FIG. 3, is open at the top but which does not extend over the entire axial length of the rail guide part 2 but is sealed at both ends. Mounted in this groove 6 so that it has sliding movement is a clamping slide 7, the exact design of which will be described later on. The movement of the clamping slide 7 occurs by virtue of an operating bar 8 with an external thread which extends through a tapped hole 9. The tapped hole 9 links the recess 6 in the rib-shaped projection 5*c* with a lateral surface of the rail guide part 2. At its outer end the operating bar 8 has a twist grip 10 which acts as manual actuator. This arrangement clearly is such that by turning the twist grip 10, the operating bar 8 is screwed axially into the tapped hole 9 and the axial movement of the operating bar 8 is transmitted form-fit to the clamping slide 7 by means of a dynamically balanced coupling head 11. The coupling head 11 on the operating bar 8 is then forced from below into a corresponding recess 12 in a main body 7a of the clamping slide 7.

Figure 4:
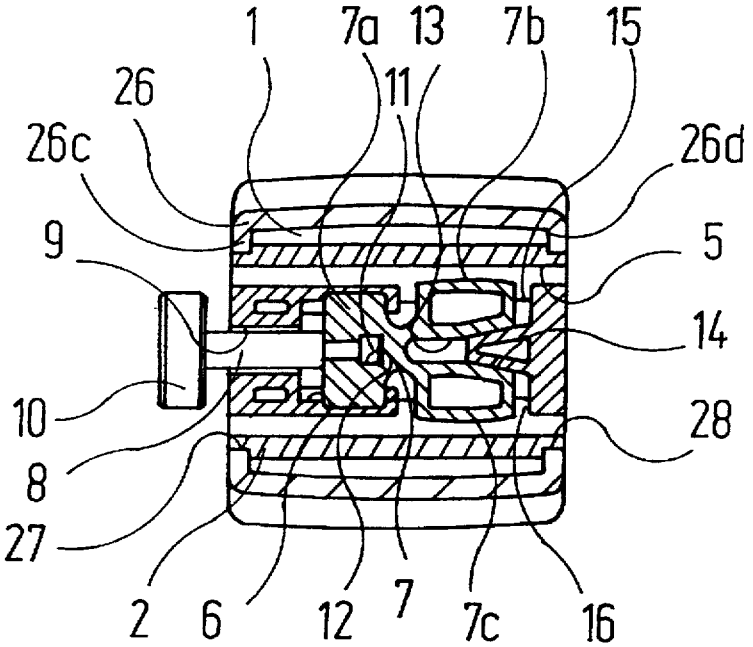
FIG. 4: shows a section through the shower rail support bracket illustrated in FIGS. 1 to 3, along the line IV—IV in FIG. 3.

As can be particularly seen from FIG. 4, two clamping jaws 7*b*, 7*c* are moulded on to the main body 7*a* in which the coupling head 11 is fixed in such a way that they are only connected to the main body 7*a* by a relatively narrow flexible material bridge. The two clamping jaws 7*b* and 7*c* of the clamping slide 7 are separated from each other by a gap 13. There extends into this gap 13 a wedge-shaped expanding projection 14 which is preformed on to the end of the recess 6 in the rail guide part 2 which is shown on the right in FIGS. 3 and 4.

As can also be particularly seen from FIG. 4, the outer faces of the clamping jaws 7*b*, 7*c* on the clamping slide 7 extend through apertures 15, 16 which link the recess 6 in the rib-shaped projection 5*c* on the rail guide part 2 to the hole 5 in the gripping surfaces 5*d* and 5*e*.

The clamping device, which consists of the clamping slide 7, the operating rod 8 with twist grip 10 and the expanding projection 14 on the rail guide part 2, operates as follows:

For preference, the clamping device is used in such a way that the weight of the hand shower including shower hose and shower support bracket is exactly compensated, and that therefore the shower support bracket along with the suspended hand shower remains in its axial position without the influence of external forces but can be moved easily by pushing or pulling it axially. The same applies for the turning capability of the housing of the shower support bracket with the hand shower suspended.

It is therefore necessary to adjust the clamping device to an appropriate braking force.

A slight braking force is achieved if the clamping slide 7 (by turning the twist grip accordingly) is at the end of the recess 6 in the rail guide part 2 which is on the left as shown in the drawing. In this position, only the outermost, comparatively narrow end of the expanding projection 14 extends into the gap 13 between the clamping jaws 7*b* and 7*c* of the clamping slide 7. The clamping jaws 7*b* and 7*c* are therefore also forced only relatively slightly, or not at all, into the hole 5 in the rail guide part 2. The outer faces of the clamping jaws 7*b* and 7*c* and thus the entire shower support bracket therefore slide relatively smoothly along the corresponding gripping surfaces of the shower rail.

If the braking force achieved is insufficient to compensate for the weight of the hand shower, the shower hose and the shower support bracket, the clamping slide 7 is moved by turning the twist grip 10 which is shown on the right in FIGS. 3 and 4. By so doing, the clamping jaws 7*b* and 7*c* are progressively pushed on to the expanding projection 14 of the rail guide part 2. Owing to the wedge shape, the two clamping jaws 7*b*, 7*c* progressively turn outwards about the material bridges which are connected to the main part 7*a* of the clamping slide 7. In this way they penetrate deeper into the hole 5 in the rail guide part 2 or press against the gripping faces of the shower rail which are located there.

Since the outer faces of the clamping jaws 7*b* and 7*c* are set at an angle to the central plane of the shower support bracket, as are the gripping surfaces of the shower rail which act in combination with them, this movement of the clamping slide 7 from left to right as seen in FIGS. 3 and 4 is also linked with an upwards deflection movement of the clamping slide 7. This deflection movement also causes the upper front face of the clamping slide to press progressively against the hole 4 in the inner housing 1, as a result of which the rail guide part 2 is also prevented from accidentally turning towards the inner housing 1.

The shower support bracket is therefore held on the shower rail and the rail guide part 2 is, at the same time, prevented from turning by the same movement of the clamping slide 7.

By turning the twist grip 10 accordingly, various coefficients of friction between the shower support bracket and the shower rail are achieved, ranging from the minimum—the figure must be high enough to allow the shower support bracket, along with the shower hose and suspended hand shower to stop at any vertical position of its path of movement—up to fully clamped.

The clamping jaws 7*b*, 7*c* are V-shaped in section in order that they can spring vertical to the gripping surface. Differences in tolerance can thus be compensated; it also means that the shower support bracket is not able to lock or slide down.

A more detailed description will now been given of the exact configuration of the conical supporting part 3 and also the way in which it is attached to the inner housing.

There is formed in the end of the housing 1 opposite the hole 4 a slit-like recess 17, the curved area of contact 17*a* of which—facing upwards in the drawing—has a diameter which matches the outer diameter of the essentially cylindrical conical supporting part 3. On its facing sides, the conical supporting part 3 has cylindrical bearing projections 18, one of which can be seen in FIG. 1. Each of the bearing projections 18 engages in a hole 19 which links the slit-like recess 17 with one side face of the inner housing 1. The bearing projections 18 can be inserted into the holes 19 by flexibly expanding the side walls of the slit-like recess 17, whereby the conical supporting part 3 is supported in the inner housing 1 but is capable of rotation.

In the generally known manner, the conical supporting part 3 is provided with a conical receiving hole 20 which is linked to the bottom outer face of the conical supporting part 3 by means of a slot 21. The conical supporting part of the hand shower is introduced into the receiving hole 20, with the result that the shower hose, which is connected to the hand shower, can pass through the slot 21.

On the side of the receiving hole 20 facing the slot 21, a curved recess 22 is made through the conical supporting part 3 (cf FIG. 3 in particular). Going through the recess 22 is a pin 23 which is attached to the inner housing 1 on opposite sides. In the embodiment shown this attachment is achieved by means of screws 24 which are screwed through holes 25 which go through the inner housing 1 into the front faces of the pin 23.

The curved recess 22 in the conical supporting part 3, together with the pin 23, limit the angle about which the conical supporting part 3 can be turned relative to the inner housing 1.

There are inserted between the screw 24 and the conical supporting part 3 a sliding disc 29 and also an elastomer disc 30 in order to allow a defined moment of rotation of the conical supporting part 3.

The assembly comprising the inner housing 1, the rail guide part 2 and the conical supporting part 3 is encompassed on the outside by the visible housing 26 which consists of two half shells 26*a* and 26*b*. The half shells 26*a*, 26*b* are brought from the side over the aforementioned assembly and are then flexibly locked together in a suitable fashion or alternatively linked so that they can be detached. The shoulders 26*c* and 26*d* on the visible housing 26 rest laterally against shouldered steps 27, 28 in the rail guide part 2 and ensure the axial position of this part.

I claim:

1. Shower support bracket for attaching a hand shower to a shower rail, in the back of which, facing away from the user, there is a groove with at least one gripping surface, comprising a) a housing;

b) a hole which receives the shower rail such that it has sliding movement;

c) a clamping device which consists of at least one clamping piece which can be pressed against the gripping surface of the shower rail with varying degrees of force in order to brake or stop the sliding movement;

d) means on said housing for supporting a component of the hand shower, characterized in that e) the clamping device comprises:

ea) a clamping piece (7) which has two clamping jaws (7*b*, 7*c*) separated from each other by a gap (13), which can be expanded elastically by increasing the intervening gap (13);

eb) a wedge-shaped expanding projection (14), the narrow front face of which is aligned with the gap (13) between the clamping jaws (7*b*, 7*c*) of the clamping piece (7), whereby ec) the clamping piece (7) and expanding projection (14) can be moved relative to each other such that, depending upon the relative position of the clamping piece (7) and the expanding projection (14), the expanding projection (14) penetrates to varying depths into the gap (13) between the two clamping jaws (7*b*, 7*c*) and in this way expands the clamping jaws (7*b*, 7*c*) to varying degrees so as to contact said at least one gripping surface.

2. Shower support bracket according to claim 1, characterized in that the clamping jaws (7*b*, 7*c*) are flexible in design, at least in one clamping direction.

3. Shower support bracket according to claim 1, characterized in that the clamping piece (7) has the form of a clamping slide with linear movement and that the expanding projection (14) is fixed.

4. Shower support bracket according to claim 3, characterized in that the clamping slide (7) can be moved by means of an operating bar (8) which can be screwed into a fixed part (2) and carries at its outer end a manual actuator (10).

5. Shower support bracket according to claim 1, characterized in that the clamping piece (7) and the clamping jaws (7*b*, 7*c*) are made in a single piece and are made of plastic, and each of the clamping jaws (7*b*, 7*c*) are flexibly connected to a main body (7*a*) of the clamping piece (7) by means of relatively narrow material bridges.

6. Shower support bracket according to claim 1, characterized in that a) the hole (5) to receive the shower rail is formed in a rail guide part (2) which can be turned relative to the housing (1, 26);

b) the clamping piece (7) or the expanding projection (14) can slide in a recess (6) in the rail guide part (2) which is open towards the housing (1, 26);

c) the gripping surfaces and/or the faces of the clamping piece (7) which act in combination with the expanding projection (14) are set at such an angle that with this relative movement the clamping piece (7) or the expanding projection (14) also moves radially towards the housing (1) or away from the housing (1) and, depending upon the relative position, is held on the housing (1) with varying degrees of force.

7. Shower support bracket according to claim 1, characterized in that said means for supporting (20) is formed on a supporting part (3) which can be turned relative to the housing (1, 26) at least about a certain angle.

8. Shower support bracket according to claim 7, characterized in that the turning capability is limited by a stop device (22, 23) which consists of:

a) a curved recess (22) going through the supporting part (3);

b) a pin (23) which is attached to the housing (1) and which passes through the recess (22).

9. Shower support bracket according to claim 7, characterized in that a) the supporting part (3) is housed in a slit-like recess (17) in the housing (1) which can be expanded elastically, b) there are preformed on to the supporting part (3) cylindrical bearing projections (18) which engage in corresponding holes (19) in the side walls of the slit-like recess (17).

10. Shower support bracket according to claim 9, characterized in that a braking device (24, 29, 30) is mounted between the supporting part (3) and the housing (1, 26).

11. Shower support bracket according to claim 1, characterized in that the housing is composed of an inner housing (1) which forms the said means for supporting and an outer, visible housing (26) which consists of several parts which are linked together but are detachable (26*a*, 26*b*).

12. Shower support bracket according to claim 11, characterized in that, the visible housing (26) has, positioned above the rail guide part (2), shoulders (26*c*, 26*d*) which lock the rail guide part (2) axially in position.

* * * * *